United States Patent [19]

Tetenborg et al.

[11] 4,036,116

[45] July 19, 1977

[54] METHOD OF STACKING FLAT BAGS OR SACKS WHICH ARE FOLDED ABOUT AT LEAST TWO TRANSVERSE FOLD LINES

[75] Inventors: Konrad Tetenborg; Rudolf Telljohann, both of Lengerich, Germany

[73] Assignee: Windmoller & Holscher, Lengerich, Germany

[21] Appl. No.: 654,921

[22] Filed: Feb. 3, 1976

[30] Foreign Application Priority Data

Feb. 5, 1975 Germany ..... 2504801

[51] Int. Cl.[2] ..... B31B 1/26

[52] U.S. Cl. ..... 93/32; 93/84 TW; 93/93 HT

[58] Field of Search ..... 93/32, 35 R, 35 H, 8 WA, 93/84 TW, 84 R, 93 HT, 93 R; 229/54 R, 54 C

[56] References Cited

U.S. PATENT DOCUMENTS

| | | | |
|---|---|---|---|
| 1,846,542 | 2/1932 | Budd | 229/54 C |
| 3,000,549 | 9/1961 | Stange et al. | 229/54 C |
| 3,142,435 | 7/1964 | Stange et al. | 229/54 C |
| 3,199,766 | 8/1965 | Vineberg | 229/54 C |

*Primary Examiner*—James F. Coan

*Attorney, Agent, or Firm*—Fleit & Jacobson

[57] ABSTRACT

To form stacks of flat folded bags, each bag comprising a mouth portion reinforced by at least one additional ply of bag material, the mouth portion and the base portion are both folded onto the central bag portion about respective fold lines so that their adjacent edges stop short of one another or just touch. The mouth portion is folded about a fold line disposed beyond the reinforcement. The base portion is either folded once about a fold line disposed inwardly of a gusset formed in the base or, if there is no gusset, in Z formation about two fold lines.

2 Claims, 7 Drawing Figures

METHOD OF STACKING FLAT BAGS OR SACKS WHICH ARE FOLDED ABOUT AT LEAST TWO TRANSVERSE FOLD LINES

The invention relates to a method of stacking flat bags or sacks which are folded about at least two transverse fold lines and are open at one end, with a reinforced margin at the opening being formed by a plurality of layers that include handle apertures.

From German Pat. No. 1,117,141 it is known to fold rectangular sheets to about one third of their original lengths by turning the end portions over onto the central portion.

From German Pat. No. 2,223,104 it is known to shorten bags which are open at one end and provided with a base seam, either to one third of the original length by turning the base and mouth portions onto the central portion or to one quarter of the original length by means of two central fold lines. If these known methods are employed to fold bags or sacks having a reinforced margin at the mouth formed by a plurality of layers that include handle apertures, the folded bags or sacks will possess varying thicknesses which, if superposed uniformly, will permit only slanting stacks to be formed which tend to slip after reaching a certain height. The disadvantage of the bags slipping after reaching a certain height cannot be overcome by providing lateral abutments or guides because the folded bags or sacks will assume an ever increasing inclined position with an increase in the stack height and will finally be disposed vertically and collapse if they consist of soft flexible material.

The present invention therefore aims to provide a method by which bags or sacks of the aforementioned kind can be superposed to form edge-aligned stacks of considerable height.

This aim is fulfilled according to the invention in that the margin at the opening is folded onto the central bag or sack portion about a fold line disposed below the reinforcing layers and the base portion of the bag or sack is folded about two fold lines in Z formation onto the central bag or sack portion in such a way that that fold line of the base portion which is nearer the margin at the opening stops short of or just touches the outer edge of the margin, and that the folded bags are stacked on one another.

By the method according to the invention, the handle portion of each bag or sack is therefore folded about a fold line that divides the bag length into a first fifth onto a second fifth and the base portion, which consists of approximately the fourth and last fifth of the bag length, is folded together with the fourth fifth onto the third fifth and the fifth fifth of the bag is then folded back onto the fourth fifth. The bags thus folded can be superposed to form edge-aligned stacks without lateral guides or supports because they will have substantially the same number of layers of bag material over their entire width. Since the margin at the opening is reinforced by an additional layer, the handle portion will consist of four layers. These layers lie on the central bag portion which consists of two layers. The other portion of the folded bag consists of three folds of two layers each, so that the folding at the base portion as well as in the region of the handle portion that is folded onto the central portion will in each case consist of six layers. Since the folding is of substantially uniform thickness across its width, the folded bags or sacks can be stacked without difficulty.

In the case of bags or sacks which have base gussetting in addition to the reinforced handle portion, the aim is fulfilled by the invention in that the margin at the opening is folded onto the central bag or sack portion about a fold line disposed below the reinforcing layers and the base portion of the bag or sack is folded about a fold line disposed above the central fold line of the gusset onto the central bag or sack portion in such a way that the edges of the margin at the opening stop short of or just touch the edges of the outer fold lines of the gusset. The handle portion is therefore folded about a fold line which divides off about one quarter of the bag length and the base portion is folded onto the remainder of the central portion of the bag.

U.S. Pat. No. 3,142,435 discloses a bag with handles and a flattened block base in which the margin at the opening is folded onto the central portion of the bag about a fold line disposed below the handles. This known manner of bag folding does not, however, render the invention obvious because the folding serves to position cord handles beneath the flattened block base, which cord handles are struck to the side walls of the bag by means of labels and project beyond the edges of the margin at the opening. The known manner of bag folding exhibits different thicknesses across its width so that it cannot be formed into edge-aligned stacks of considerable height and does not teach how bags of the aforementioned kind can be folded in the manner of the invention to solve the stated problem.

Bags or sacks with a doubly reinforced handle portion and base gussetting can similarly be folded and stacked in accordance with the first aspect of the invention. For such bags, the Z folding of the base portion is carried out so that the first fold is effected about a fold line disposed above the central fold line of the gusset. The folded bag will then have eight layers in the handle portion as well as in the base portion.

If the outer edges of the margin at the opening and the folded edges of the base portion do not touch, so that a gap remains between them, the lower number of layers at the centre of the folded bags will not prove disadvantageous during stacking.

Examples of the invention will be described in more detail with reference to the drawing. In the drawing.

Figure 1:
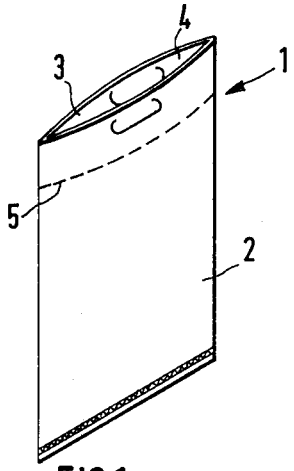
FIG. 1 is a perspective view of a bag.
Figure 2:
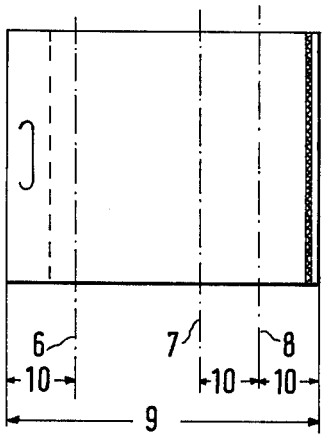
FIG. 2 is a plan view of a bag.
Figure 3:
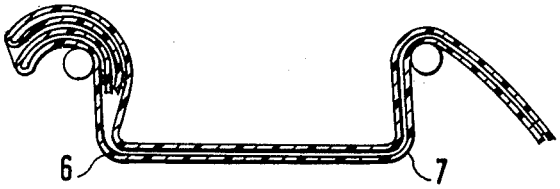
FIGS. 3 to 5 are diagrammatic side elevations of different steps during folding of the bag portions.
Figure 4:
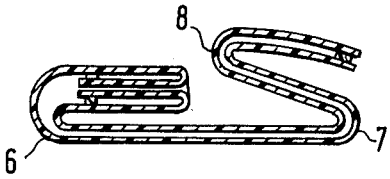
Figure 5:
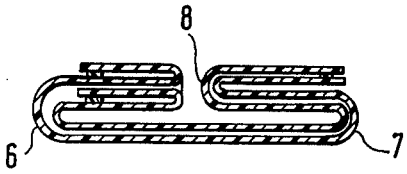
Figure 6:
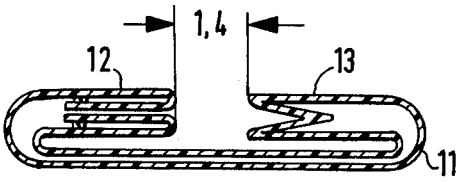
FIG. 6 shows a variation of the bag folding.
Figure 7:
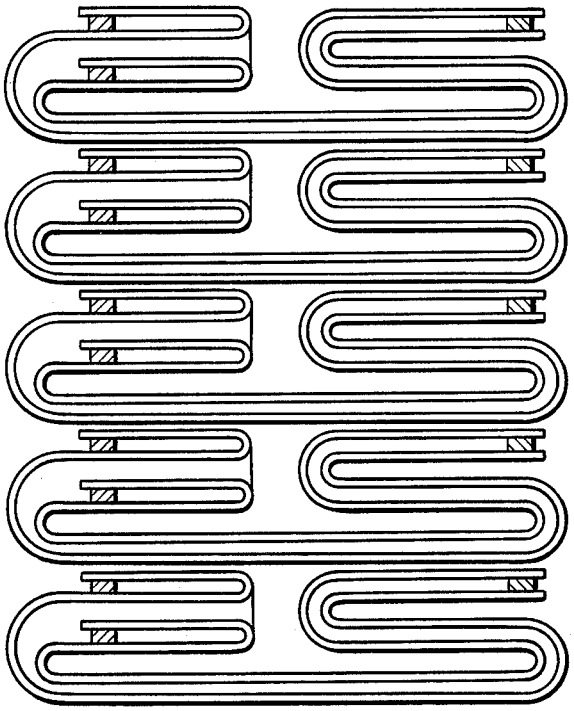
FIG. 7 shows the stacked bags.

A bag 1 consists of a front wall 2 and a rear wall 3. In the handle portion 4, the walls are turned over and the turned-over portion is for example welded to the wall by a weld seam 5. Each handle portion 4 therefore consists of two layers. In the plan view of FIG. 2, fold lines 6 to 8 are shown in broken lines, the length of the bag being designated 9 and the spacing of the fold line 6 from the upper edge of the bag handle and of the fold line 8 from the lower edge as well as the spacing of the fold lines 7 and 8 from one another being designated 10. The dimensions 9 and 10 are in this example in the ratio of 5:1. The first fifth of the bag length is disposed between the upper edge of the bag and the fold line 6, the fourth fifth between the fold lines 7 and 8, and the last fifth between the fold line 8 and the lower bag edge. The second and third fifths lie between the fold lines 6 and 7. FIG. 3 shows how the handle portion is folded about the fold line 6 and the base portion consisting of the fourth and fifth fifths is folded about the fold line 7. In FIG. 4, the first fifth is already disposed on the second fifth and the fourth fifth is being folded onto the third fifth. The fifth fifth is already bent about the fold line 8 towards the fourth fifth. FIG. 6 shows a folded bag 11 with handle portion 12 and base portion 13. The handle portion 12 of each wall is provided with single reinforcement. The base portion 13 contains a gusset. The handle portion 12 and base portion 13 are folded over onto the central portion of the bag 11. Between the handle and base portions there is a spacing 14 so that the number of layers is equal on the left and right halves of the folded bag 11 and the portions with fewer layers are located in the middle.

We claim:

1. A method of stacking flat bags or sacks which are folded about at least two transverse fold lines and are open at one end, with a reinforced margin at the opening being formed by a plurality of layers that include handle apertures, the method comprising the steps of folding the margin portion of the bag onto the central bag or sack portion about a fold line disposed below the reinforcing layers, folding the base portion of the bag or sack about two fold lines in Z formation onto the central bag or sack portion in such a way that the fold line of the base portion which is nearer the margin at the opening of the bag stops short of or just touches the outer edge of the margin, and stacking the folded bags on one another.

2. A method of stacking flat bags or sacks which are folded about at least two transverse fold lines and are open at one end, with a reinforced margin at the opening being formed by a plurality of layers that include handle apertures and with gussets at the base of the bag, said gussets having a central fold line and outer fold lines, the method comprising the steps of folding the margin portion of the bag onto the central bag or sack portion about a fold line disposed below the reinforcing layers, folding the base portion of the bag or sack about a fold line disposed above the central fold line of the gusset onto the central bag or sack portion in such a way that the edges of the margin at the opening of the bag stop short of or just touch the edges of the outer fold lines of the gusset, and stacking the folded bags on one another.

* * * * *